US010317020B1

(12) United States Patent
McChesney

(10) Patent No.: US 10,317,020 B1
(45) Date of Patent: Jun. 11, 2019

(54) PAINT COLOR MATCHING LIGHT

(71) Applicant: Thomas McChesney, Coatesville, PA (US)

(72) Inventor: Thomas McChesney, Coatesville, PA (US)

( * ) Notice: Subject to any disclaimer, the term of this patent is extended or adjusted under 35 U.S.C. 154(b) by 20 days.

(21) Appl. No.: 15/342,148

(22) Filed: Nov. 3, 2016

Related U.S. Application Data

(60) Provisional application No. 62/249,974, filed on Nov. 3, 2015.

(51) Int. Cl.

| | |
|---|---|
| ***F21L 4/00*** | (2006.01) |
| ***F21L 4/02*** | (2006.01) |
| ***F21V 23/04*** | (2006.01) |
| ***F21Y 115/10*** | (2016.01) |

(52) U.S. Cl.
CPC ..... *F21L 4/027* (2013.01); *F21L 4/005* (2013.01); *F21V 23/0428* (2013.01); *F21Y 2115/10* (2016.08)

(58) Field of Classification Search
CPC . F21L 4/027; F21L 4/005; F21L 14/02; F21L 2003/00; F21L 4/00; F21B 23/0428; F21Y 2115/10; F21V 23/0428
See application file for complete search history.

(56) References Cited

U.S. PATENT DOCUMENTS

| | | | | |
|---|---|---|---|---|
| 6,753,661 | B2 | 6/2004 | Muthu et al. | |
| 6,949,772 | B2 * | 9/2005 | Shimizu | F21L 4/00 257/88 |
| 7,190,587 | B2 | 3/2007 | Kim et al. | |
| 7,461,944 | B2 * | 12/2008 | Alessio | F21L 14/00 362/184 |
| 8,425,085 | B2 * | 4/2013 | Van Laanen | F21V 3/02 362/218 |
| 8,733,949 | B2 | 5/2014 | Chong et al. | |
| 8,796,948 | B2 | 8/2014 | Weaver et al. | |
| 8,817,243 | B2 | 8/2014 | Jung et al. | |
| 8,933,644 | B2 * | 1/2015 | David | F21V 9/30 315/291 |
| 2002/0097000 | A1 | 7/2002 | Muthu et al. | |
| 2006/0133089 | A1 * | 6/2006 | Reid | F21L 4/00 362/294 |
| 2007/0273290 | A1 | 11/2007 | Ashdown et al. | |
| 2010/0127299 | A1 | 5/2010 | Smith et al. | |
| 2011/0012494 | A1 | 1/2011 | Yoo | |

(Continued)

FOREIGN PATENT DOCUMENTS

| | | |
|---|---|---|
| CN | 201983006 U | 9/2011 |
| CN | 104180283 A | 12/2014 |

(Continued)

OTHER PUBLICATIONS

Yilmazer, Hakan et al. "Intelligent Over Temperature Protection for LED Lighting Applications", www.infineon.com Oct. 1, 2013. 16 pages.

*Primary Examiner* — Peggy A Neils
(74) *Attorney, Agent, or Firm* — Joseph E. Maenner; Maenner & Associates, LLC

(57) ABSTRACT

A paint color matching light is disclosed. The light includes a housing, a power supply mounted in the housing, and a bulb mounted in the housing and electrically coupled to the power supply. The bulb has a color reading index over 80. The light has an absence of a cooling fan.

16 Claims, 9 Drawing Sheets

(56) References Cited

U.S. PATENT DOCUMENTS

| | | | | |
|---|---|---|---|---|
| 2011/0018418 | A1 | 1/2011 | Yoo | |
| 2013/0051002 | A1* | 2/2013 | Draper | F21V 29/004 362/231 |
| 2014/0313744 | A1 | 10/2014 | Collias | |
| 2015/0061498 | A1 | 3/2015 | Paffrath et al. | |
| 2016/0076736 | A1* | 3/2016 | Van Bommel | A61B 5/0071 435/29 |
| 2016/0161069 | A1* | 6/2016 | Lam | F21L 4/027 362/205 |
| 2017/0114962 | A1* | 4/2017 | Bian | F21L 4/005 |
| 2018/0170321 | A1* | 6/2018 | Lipson | B24B 1/00 |

FOREIGN PATENT DOCUMENTS

| | | |
|---|---|---|
| CN | 204437946 U | 7/2015 |
| WO | WO2006065589 | 6/2006 |

* cited by examiner

PAINT COLOR MATCHING LIGHT

CROSS-REFERENCE TO RELATED APPLICATION

The present application claims priority from U.S. Provisional Patent Application Ser. No. 62/249,974, filed on Nov. 3, 2015, which is incorporated herein by reference in its entirety.

BACKGROUND OF THE INVENTION

The automotive body repair industry requires exacting standards to ensure proper color matching of vehicles being repaired there, in an expected procedure to return the damaged vehicle to pre-accident condition and with an invisible paint repair to the rest of the car not being painted. While factory standard colors may be provided to an auto body repair shop, variations of those colors from the factory standard occur often and those formulas and sprayed out samples are offered as additional variations of the standard color for the refinisher to compare against the vehicle to be repaired and evaluate to determine the best possible match. Pre sprayed samples of the original color and the variations offered are compared to the vehicle targeted for repair prior to the refinishing process.

In order to correctly evaluate color samples to a color on a repair vehicle, a pure white light source is required. Currently available white light sources for auto body shops either do not provide as pure of a white light as possible or get so hot during operation that they can only be used for a very limited amount of time and automatically shut down to prevent overheating, sometimes before the body shop technician can properly match colors.

It would be beneficial to provide a white light source for auto body shops to match paint colors that provides as pure white light as possible, the light having a Color Rendition Index that reflects its ability to produce all colors in the 400 to 700 nanometer color wavelength spectrum and operates as sufficiently low temperature that the light does not automatically shut down due to overheating.

BRIEF SUMMARY OF THE INVENTION

Briefly, the present invention provides a paint color matching light. The light includes a housing, a power supply mounted in the housing, and a bulb mounted in the housing and electrically coupled to the power supply. The bulb has a color reading index over 80. The light has an absence of a cooling fan.

The present invention further provides a paint color matching light including a housing, a power supply mounted in the housing, and a bulb mounted in the housing and electrically coupled to the power supply. The bulb is rated at 5000 Kelvin. The light has an absence of active and passive cooling mechanisms.

Additionally, the present invention provides a kit for building an inventive light from an existing light housing.

BRIEF DESCRIPTION OF THE DRAWINGS

Aspects, features, and advantages of the present invention will become more fully apparent from the following detailed description, the appended claims, and the accompanying drawings in which like reference numerals identify similar or identical elements.

DETAILED DESCRIPTION

Figure 1:
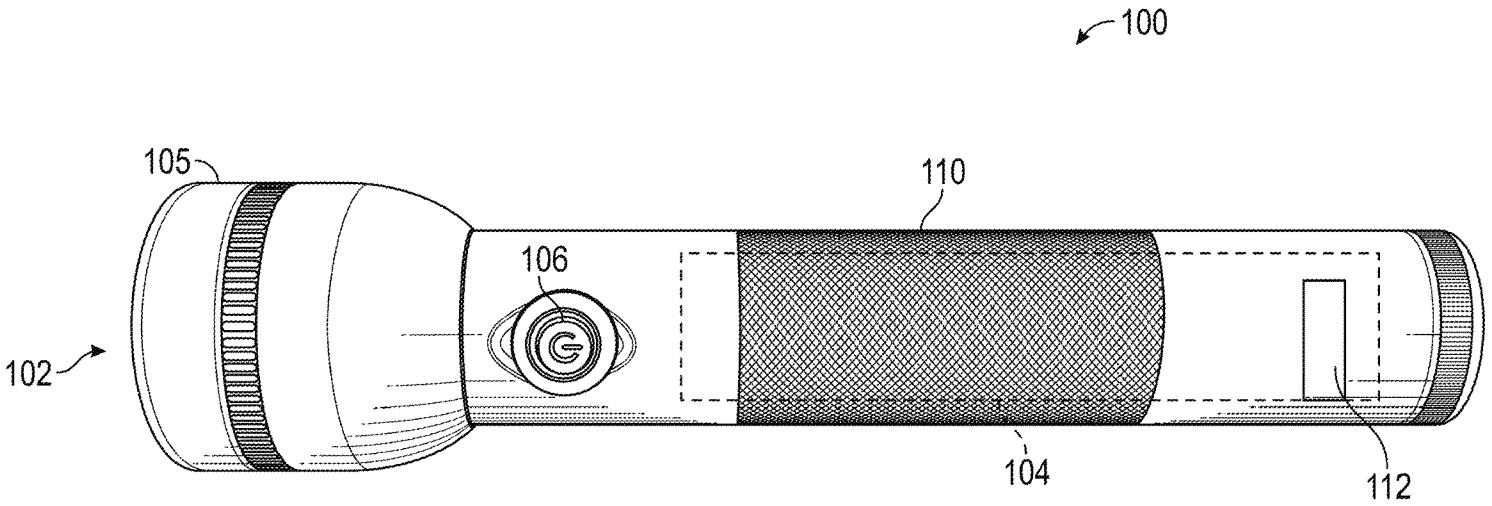
FIG. 1 shows a paint color matching light according to a first exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

As used herein in reference to an element and a standard, the term "compatible" means that the element communicates with other elements in a manner wholly or partially specified by the standard, and would be recognized by other elements as sufficiently capable of communicating with the other elements in the manner specified by the standard. The compatible element does not need to operate internally in a manner specified by the standard.

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

Figure 2:
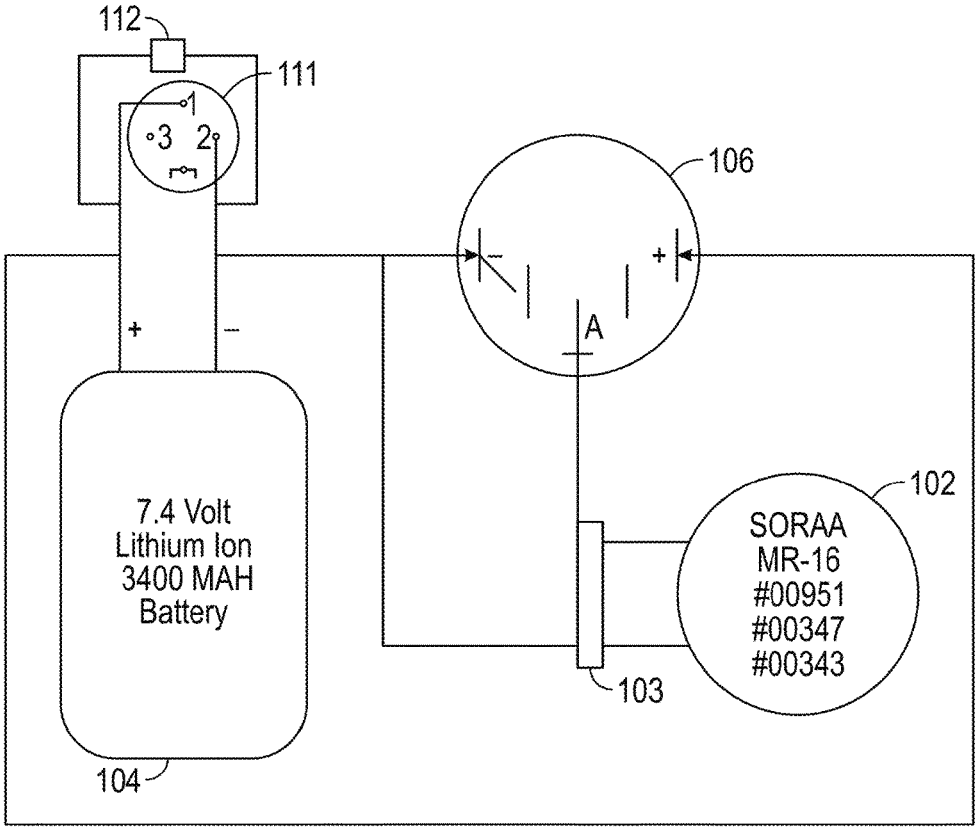
FIG. 2 shows a schematic view of an exemplary electrical system used with the paint color matching light shown in FIG. 1.
Figure 3:
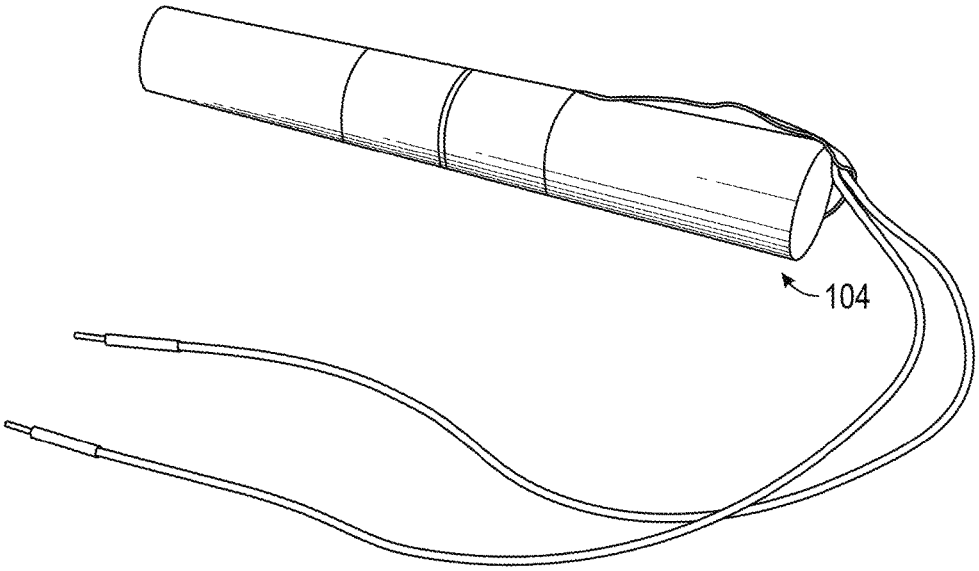
FIG. 3 shows a perspective view of an exemplary battery used with the light shown in FIG. 1.
Figure 3A:
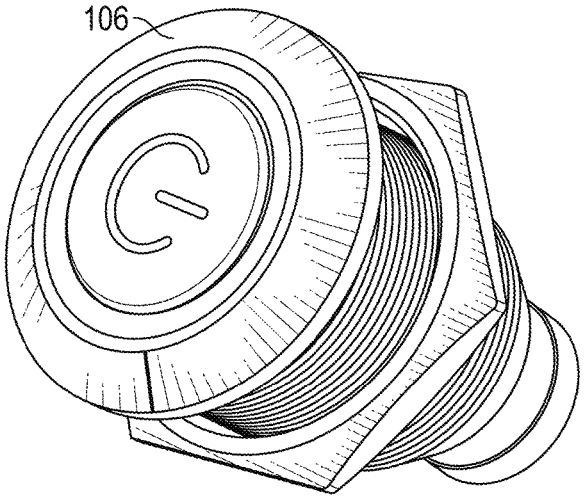
FIG. 3A shows a perspective view of an exemplary switch used with the light shown in FIG. 1.
Figure 4:
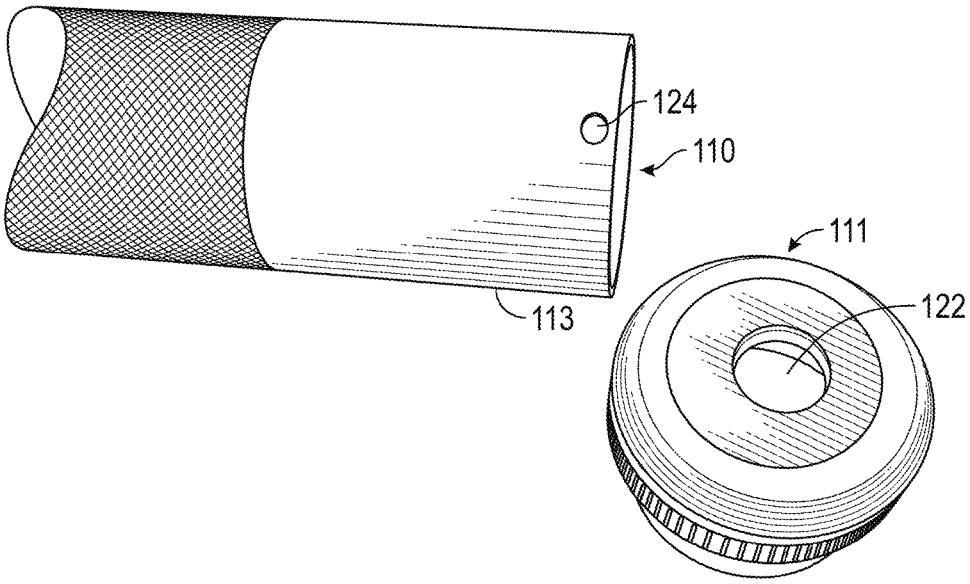
FIG. 4 shows a perspective view of a cap end of a housing and an end cap used with the light shown in FIG. 1.

Referring to FIGS. 1 and 2, a paint color matching light 100 ("light 100") according to a first exemplary embodiment of the present invention is shown. Light 100 is a handheld light that can be battery-operated for portability. Light 100 includes an LED bulb 102 to generate the required "white" light. A housing 110 is provided to retain bulb 102, a power source in the form of a battery 104, shown in FIG. 3, and an on/off switch 106, shown in FIG. 3A. A battery cap 111 can be releasably connected to housing 110 and can be removed from housing 110 as shown in FIG. 4 to remove and replace battery 104 as required. Cap 111 includes electrical connections to prevent operation of light 100 without cap 111 being properly installed on housing 110.

Figure 5:
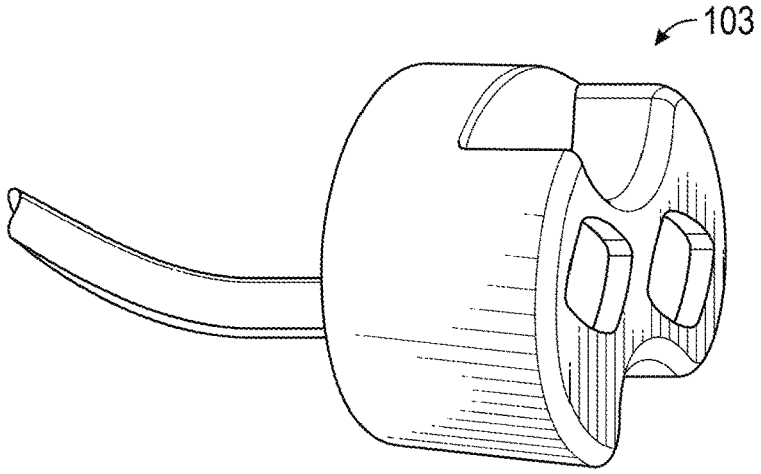
FIG. 5 shows a perspective view of an exemplary bulb base used with the light shown in FIG. 1.
Figure 6:
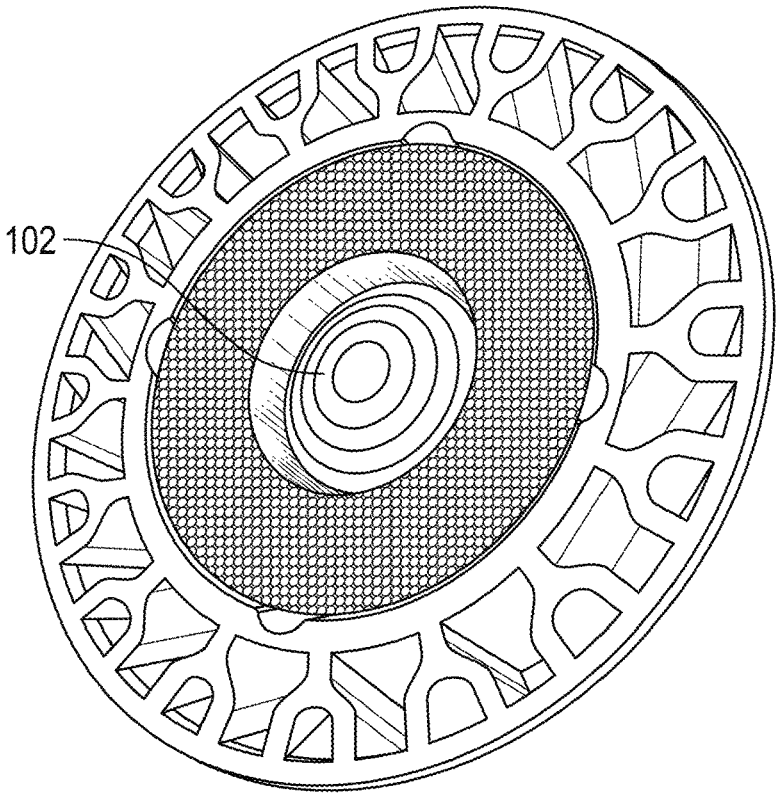
FIG. 6 shows a perspective view of an exemplary bulb used with the light shown in FIG. 1.

In an exemplary embodiment, LED bulb 102 can be an MR 16 bulb with a GU 5.3 base 103, shown in FIG. 5, such as, for example, a Soraa 00349, 7.5 W LED, shown in FIG. 6. Alternatively, Soraa 00951, Sorra 00927, Sorra 00939, Soraa 00347, Sorra 00345, Sorra 00909, Sorra 00911, Sorra 00913, Sorra 00915, Soraa 00343, or AR-111 bulbs can be used. Such bulb 102 has a color rendering index ("CRI") of 95.0 and is rated 5000 Kelvin. A benefit of bulb 102 is that bulb 102 emits, among other wavelengths, wavelength between 400 and 440 nm (violet light). Additionally, bulb 102 has an R9 rating above 90 and, in an exemplary embodiment, about 95. Such features are important when using light 100 to accurately evaluate an attempt to match sprayed out samples of the original and of variant colors of a given factory color code, for a vehicle having that same color code and in the refinish process in a collision repair shop.

Further, bulb 102 can provide a viewing angle between 9° and about 60°. More specifically, bulb 102 can provide a viewing angle of about 36°.

Additionally, in order to reduce the weight of light 100, light 100 does not include or require any type of cooling fan or active heat dissipation mechanism. Further, in an exemplary embodiment, light 100 does not include or require any heat dissipating fins for passive heat dissipation, with the exception of heat dissipating fins that may be factory provided with bulb 102. It is believed that, during operation, bulb 102 only heats up about 12° Fahrenheit (about 5° Celsius) higher than ambient temperature, so even such passive heat dissipation may not necessarily be required. An additional benefit of the low operating temperature of bulb 102 is that light 100 does not require an automatic shutdown system in the event that bulb 102 begins to overheat, allowing bulb 102 to remain lit indefinitely. Consequently, light 100 can be operated indefinitely, without the need to shut down due to actual or potential overheating.

Bulb 102 is removably insertable into socket/base 103 in housing 110. The bulb socket is that of an MR16 bulb, specifically with a GU5.3 style base.

Figure 7:
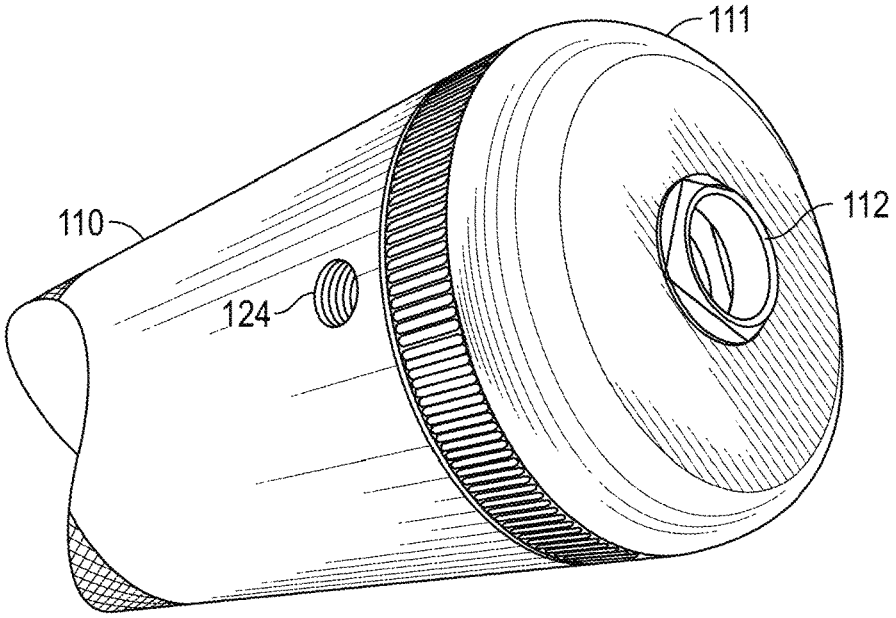
FIG. 7 shows a perspective view of an exemplary charger used with the light shown in FIG. 1.

Battery 104 can be a single battery or a plurality of batteries connected electrically in series. Optionally, battery 104 can be a single rechargeable battery, such as, for example, a lithium-ion battery. If battery 104 is rechargeable, housing 102 can include a battery charging connection 112 (shown in FIG. 7) formed thereon that is electrically connected to battery 104 to allow for an electrical connection between battery 104 and a charging power source (not shown). Battery charging connection 112 can be a mini XLR port, or other such type of electrical connection.

In an exemplary embodiment, bulb 102 requires a battery 104 that can provide about 7.4 volts/3400 MaH, resulting in an operational time of about three hours. Because of the significantly longer operational time than prior art lights, light 100 does not require a low voltage shutdown circuit, however a lithium ion battery pack consisting of two 18650 style cells, incorporates a PCB circuit that will protect the battery pack from overcharging, with an automatic shutoff at 6.0 volts. Optionally, although not shown, a circuit breaker can be electrically connected to battery 104 and is designed to open if electrical current through the breaker exceeds a predefined value.

Housing 110 can be an elongate tubular housing such as, is familiar with common household flashlights.

An exemplary procedure for manufacturing light 100 from a kit is provided below.

In order to accommodate battery 104, battery retention sleeves, charging port 112, on/off switch 106, bulb 102 and bulb base 103 from a host flashlight must be disassembled accordingly. The following is what is removed and in the order for subsequent items to be easily removed:

Unscrew tail cap 111 and remove the existing dry cell battery spring, then the extra bulb and any foam packing (not shown), if provided.

If provided, remove the rubber switch cover originally used as an on/off switch to expose the access hole in the dead center of the switch post. Insert the proper size Allen wrench into the dead center of the existing switch post and locate the switch assembly mounting screw located near the opposite end of the flashlight tube. Turn the wrench counter-clockwise four or five turns to release the entire switch assembly from the flashlight tube and allow the assembly to slide out in one piece through the end cap opening.

Unscrew the entire bulb housing from the flashlight, exposing the open tube at that end. Remove the end cap, plastic lens and the refraction mirror. Next, remove the plastic lens, refraction mirror, switch assembly, battery spring and extra bulb with foam packing. The host flashlight is now disassembled into four major components: the end cap, bulb housing, main flashlight tube and tail cap. Building the color correction analyzer light 100 can now begin.

Two holes need to be drilled. One hole 122 is in the exact center of tail cap 111 to accommodate a mini XLR charging port; the other hole 124 is located on the main flashlight tube 110 near the end by the tail cap 111 and is for an Allen set screw used to restrict the tail cap 111 from movement after assembly.

A self-latching push button on/off switch 106 has four main terminals which require soldering connection wiring to. This is done prior to installing the switch 106 into housing 110. The terminals should individually indicate + for connection to 7.4 volt battery positive wire, – for connection to the battery negative wire, "NO" (normally open) for connection to one of the MR16 terminals, and LED which gets connected directly to the "NO" terminal on the switch. Make 2 22-gauge wires, red and black and cut to length so they will reach from the switch 106 to about two inches beyond the tube end cap end 111 of the housing 110. Solder the red wire end to the + terminal on the switch 106, then solder the black wire end to the – terminal of the switch 106. Connect the LED terminal on the switch 106 to the "NO" terminal on the switch 106 using a 22 gauge short jumper wire, or if the terminals are located close enough to one another bend the terminals together with pliers until they touch each other, then solder them together as one terminal. Use this terminal that was just soldered together, and solder the end of a 22 gauge wire as long as the black and red wires to it. This will be connected to the bulb 102 on one of its terminals. Next, cut a 22-gauge piece of black colored wire as long as the rest of the wires and solder it to the – terminal of the switch 106. This wire will be connected to the other terminal of the bulb 102.

At this point switch 106 has four wires, 2 black, one red, and one white, all wires long enough to go through the flashlight tube 110 from the switch housing 106 past the tail cap 111 approximately 2 inches. At the end of the wires on the opposite end of the switch 106, tape all 4 wires together so they are in a bundle, as close together as possible.

Insert the taped end of the wiring harness of the switch 106 into the switch mounting hole on the flashlight tube 110 and direct the harness toward the end cap end of the flashlight tube 110 and insert the switch body into the flashlight tube 110. Take the switch retention nut and place over the wiring harness at the end cap end and hold upside down until the nut travels along the wiring harness and stops moving inward at the terminal end of the switch 106. Thread the nut on to the switch body completely down until it contacts the flashlight tube 110 then tighten into place. The switch 106 is now installed An exemplary battery 104 is a lithium ion, 7.4 volt, 3400 MaH battery which is comprised of two 18650 batteries in sequence and in series, with an on-board PCB for over-charge, over-draw, and direct short protection. Battery 104 can be held into place inside the flashlight tube 110 with three, 34 mm gray urethane electrical conduit in line couplers, which are inserted into the flashlight tube 110 one against the other, forming one isolated cavity to house the battery 104. Small, 1 inch by ⅛ inch rectangular pieces of foam can be pressed into the tube ends, surrounding the battery 104 for final securing.

Before inserting the battery housing, remove the tape holding together the four wires connected to the switch 106. Then aim the white wire and one of the black wires toward the other end of the tube 110 and fish the wires toward the switch end of the tube 110, past the switch 106 and through the opening at the bulb end of the tube 110. These wires will be connected to the bulb 102 later in the installation. Place the flashlight tube 110 with the switch end of the tube 110 toward the floor, and the white and black wires at that end positioned inside the tube out of the way. With the tube 110 firmly and square on the floor or other rigid surface, insert one of the three gray urethane couplers into the tail cap end of the tube 110. Position the red and black wires protruding from that end of the tube so they are in the center of the urethane bushing. Use a 16 mm or equivalent deep socket, or any similar size tool that size and place into the bushing so enough of the tool is accessible to drive with a hammer. Tap the first bushing into the tube 110 until the first bushing is ⅛" away from contacting the switch body. Insert the second bushing, and following the wiring recommendation from the first, drive the second bushing into the tube 110 until the second bushing contacts the first bushing. Repeat this process with the third and final bushing and the battery housing is installed.

Insert the battery 104 into the battery housing until battery 104 is completely inside the housing, visible from the tail cap end 113 of the main tube 110. The red and black wires connected to the battery 104 need to be protruding through the main tube at the tail cap end. Insert four foam pieces described earlier into the battery housing with a small dental pick or similar tool so that the foam pieces are evenly spaced around the battery 104 and are tight with respect to battery 104. Repeat this process at the other end of the tube 110, now the battery 104 is held firmly in place and with shock absorbing protection. The battery 104 is now installed.

Take the tail cap 111 with pre drilled hole 122 to accommodate a mini xlr fitting 112, and install the mini xlr fitting 112 into the tail cap 111 and tighten the fitting nut on the inside of the tail cap 111. Cut a 22 gauge red and 22 gauge black wire to 2 inches in length and strip both ends for soldering. Solder the end of the red wire to terminal 1 on the mini xlr fitting 112, and the end of the black wire to terminal number 2 on the xlr fitting 112. The tail cap assembly is now complete and ready for connection after the battery 104 is connected to the red and the black wires soldered to the switch 106. Connect and solder the red battery wire and the red switch wire that runs through the tube to the switch together. Repeat this process for the two black wires, one from the battery 104 and one connected through the tube 110 to the switch 106. Take the assembled tail cap assembly and solder the red wire from it to the two connected red wires in the tube from the previous battery connection. Connect and solder the black wire from the tail cap assembly and solder to the black two wires previously connected in the last step. Insulate all soldered connections, then place the tail cap assembly 111 at the end of the tube 110 with all wires clear of the flashlight tube threads. Spin the tail cap 111 counter clockwise 5 or 6 rotations to wind the wires connected to the harness inside that direction, then begin to screw the tail cap 111 into the flashlight tube 110 until tight. The wiring inside has now followed spinning in the clockwise direction leaving no tension on them inside.

Figure 8:
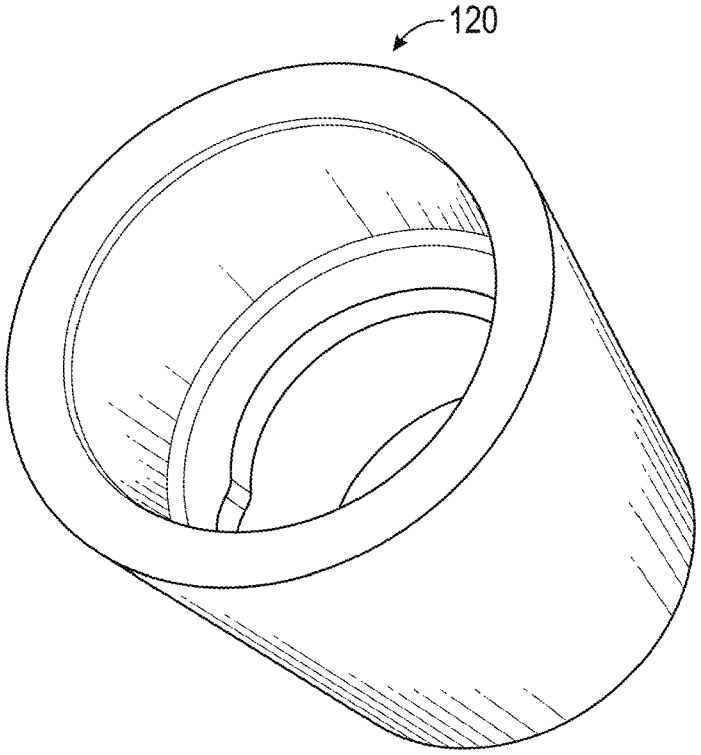
FIG. 8 shows a perspective view of an exemplary bulb housing used with the light shown in FIG. 1.

Connect and solder the two wires connected to the ceramic GU5.3 bulb socket 120, shown in FIG. 8, to the white and black wires at the bulb end of the tube 110. Polarity does not matter as the bulb 104 operates in AC mode and DC mode. Attach and thread on to the flashlight tube 110 the bulb housing 105 (shown in FIG. 1) and screw until tight. Make sure the GU5.3 base is fed through the bulb housing 105 first. Plug the bulb 104 into the base 103 and push into the bulb housing 105 until the face of the bulb 104 is flush with the opening of the bulb housing 105. Place a 2" diameter glass lens in to the bulb housing 105 threaded end cap, and thread on to the bulb housing 105 until tight.

At the tail cap assembly of the light housing 110, where the small hole 124 was drilled into the housing near the end of the tube, locate the hole 124 and with a ⅛" drill bit drill inside the existing hole into the tail cap assembly almost all the way through in to the inside of the flashlight tube 110, but not all the way. Thread the ⅛" hole with a M4 metric tap, and then inert a M4 Allen head set screw into the hole until it is flush or just under the exterior flashlight tube. Use blue thread locker on the set screw.

Select a lithium Ion battery charger 112 with the rating clearly marked for a 7.4 volt lithium Ion battery pack and with a 1.5 amps or higher charge rate. Begin by cutting off whatever plug end came with the charger 112, and confirm the positive and negative wires. Strip the wire ends and prepare to solder them to the mini xlr plug 112.

The 3 pin mini xlr plug commonly referenced as a TA3F will now be attached to the two wires on the battery charger 112. On the plug assembly remove the outer casing, wire holder and the inner and outer terminal assemblies and slip all but the outer terminal assembly over the battery charger wires that are prepared for soldering, and in the order they were removed. Place the outer terminal assembly in a vice and solder the battery charger's positive wire end to terminal number 1, then solder the battery charger's negative wire to terminal number 2; reinstall the inner terminal assembly and wire holder into the outer terminal assembly; and push all three back into the outer metal plug housing, then crimp the battery charger wire assembly to the wire holder. Thread the outer plug casing on to the over metal plug casing until tight. The battery charger is now complete.

Insert the battery charger's XLR plug end into the XLR receptacle located on the tail cap end 113 of the newly assembled light 100. Plug the battery charger into a 110 VAC outlet and observe on the body of the battery charger a red light indicating charging mode. After an hour or more the red light will turn green indicating a complete battery charge has taken place. Unplug the light 100 from the battery charger and push the on/off button on body 110 until it latches on, illuminating both the LED power indicator inside the switch itself and the bulb 104 inside the bulb housing. Push the light switch 106 on the body 110 again, switch 106 will release from the locked on condition, and the light and switch LED will turn off. The light 100 has now been completed, charged and operated through one cycle.

In operation, while holding light 100, a user switches on/off switch 106 to the on position, generating a white light. The user shines the white light onto a surface, determining the proper color of the surface. The user does not need to "hurry" to determine the proper color because bulb 102 in light 100 will not get sufficiently hot to cause like 100 to automatically shut down due to excessive temperature. Additionally, because of the relatively low power draw of bulb 102, user also does not need to "hurry" to perform the color determination prior to the expiration of the usable life of battery 104.

Figure 9:
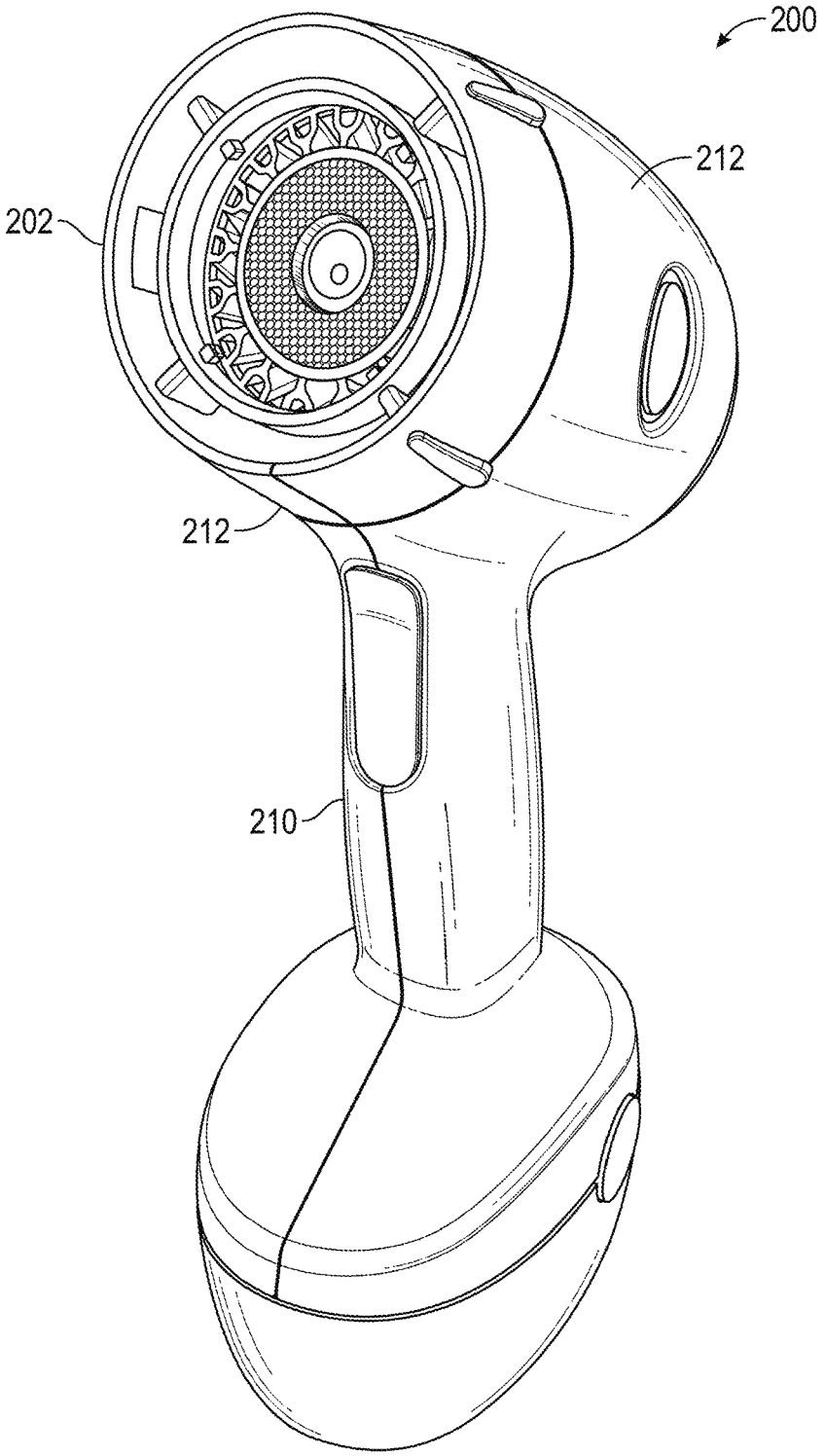
FIG. 9 shows a paint color matching light according to a second exemplary embodiment of the present invention.

In an alternative embodiment of a light 200 according to the present invention, shown in FIG. 9, a housing 210 can be "pistol grip" housing.

Figure 10:
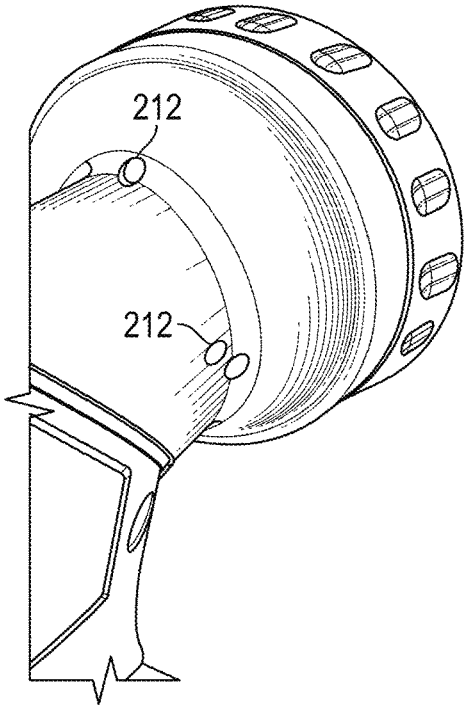
FIG. 10 shows a rear perspective view of an exemplary housing of the light shown in FIG. 9.

In an exemplary embodiment, light 200 can include passive heat dissipation in housing 210 in the form of vents 212, shown in FIG. 10, formed in housing 110. Vents 212 allow any hot air from within housing 210 to escape from housing 110. While vents 212 are provided, it is believed that, during operation, bulb 202 only heats up about 7° Fahrenheit from ambient temperature, so even such passive heat dissipation may not necessarily be required.

Figure 11:
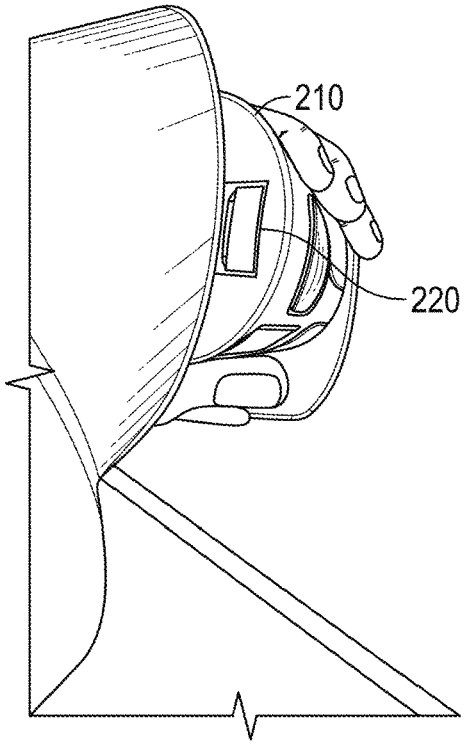
FIG. 11 shows a perspective view of an exemplary retention ring of the light shown in FIG. 9.

An exemplary method of making light 200 is now provided. Unscrew the bulb housing outer threaded retention ring which contains the clear plastic lens, reflector and 18 volt original bulb. Remove the three Torx head screws on the handle of the light. Spin the adjustable bulb housing half way (90 degrees) and expose the retention clip 220, shown in FIG. 11, that otherwise is hidden by the bulb housing located on the small end top of the yellow light assembly handle. Using a small flat screwdriver pry the retention clip 220 away from the yellow housing 210 and remove.

Split the two halves of the light assembly apart exposing the wiring and the switch mechanism inside. Cut the two wires that run inside to the bulb housing right at the top of the yellow handle assembly 210, now completely separating the housing from the handle assembly. Inside the bulb housing, looking at it from the outer lens side, locate 2 small Philips head screws, and one larger Philips head screw. Remove the two small screws which will now allow you to remove the entire spring assembly attached to the housing 210. Remove the larger screw completely and release the two ball bearings and spring located under the screw that was removed.

With a grinder tip, grind away the entire plastic area that the larger screw and its components occupied, drill four holes of ⅛" size, evenly spaced in a circle in the back of the bulb housing in the area that transitions to being 360 degrees round. These holes are vents 212 for venting the housing 210.

Figure 12:
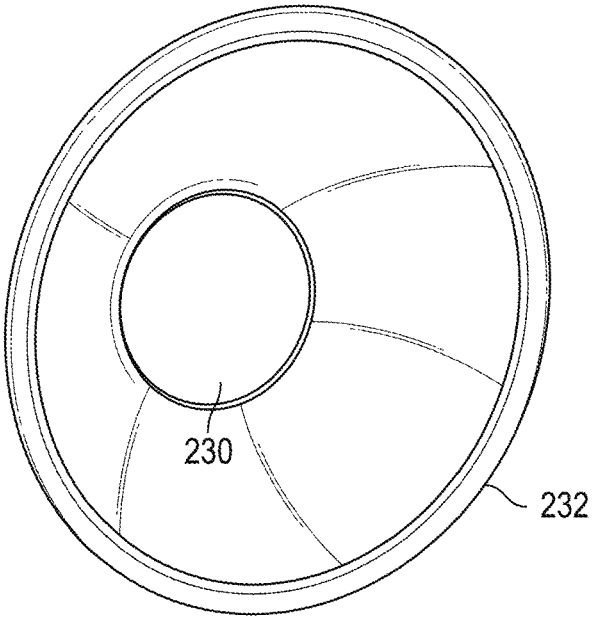
FIG. 12 shows a perspective view of an exemplary reflector of the light shown in FIG. 9.
Figure 13:
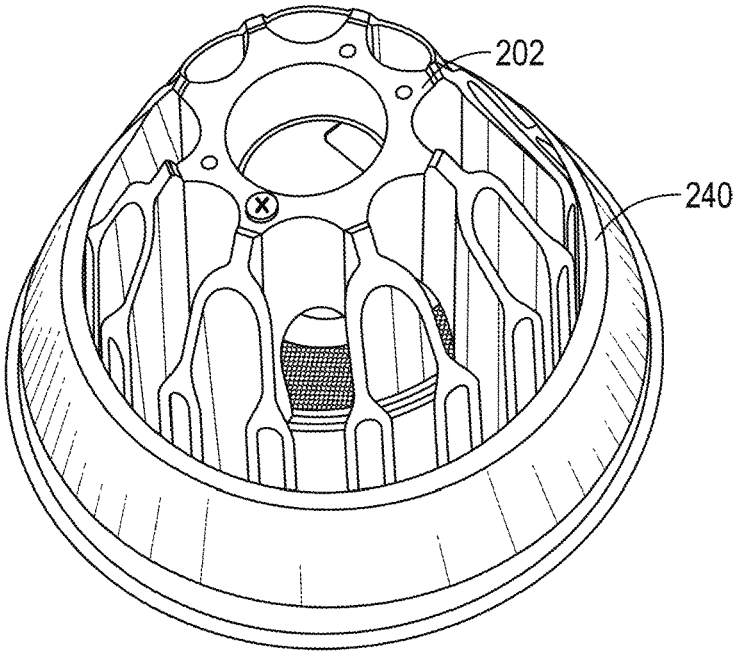
FIG. 13 shows a rear perspective view of an exemplary bulb of the light shown in FIG. 9.

Referring to FIG. 12, cut a centered hole 230 in the reflector 232 in the back to 1 inch in diameter. Insert the connection end of bulb 202 into the reflector 232 so bulb 202 rests firmly inside the reflector 232. Mix some Valvoline 8000, 2 part urethane bonding adhesive 240 and brush evenly on the back of the bulb 202 as shown in FIG. 13 and on to the reflector 232. Allow to dry for one hour.

Lay the bulb housing retention ring face down on the table. Drop in the plastic lens first, and then the completed reflector assembly and snap into place. Plug the ceramic bulb base into the bulb 202 and hold the completed reflector assembly with lens and retention ring close to the bulb housing. Feed the two wires connected to the ceramic bulb base through the center hole in the bulb housing and thread the retention ring with reflector and lens assembly tightly on to the bulb housing. The modified bulb housing is now complete.

Re-attach the modified bulb housing to one half of the yellow handle assembly allowing the 2 wires to access the switch assembly. Attach one of the bulb wires to the red wire connected to the battery prong and the other wire to the black wire connected to the switch. Polarity does not matter as the bulb 202 operates on both AC and DC voltages. Re-install the housing retention clip 220, join the two halves of the yellow housing together, re-install the 3 Torx handle assembly screws and the modification is complete.

Install an original 18 volt battery into the handle of the light 200 and snap firmly into place. Slide the on/off switch upward and light 200 will light up. Slide the switch back downward to turn light 200 off.

Figure 14:
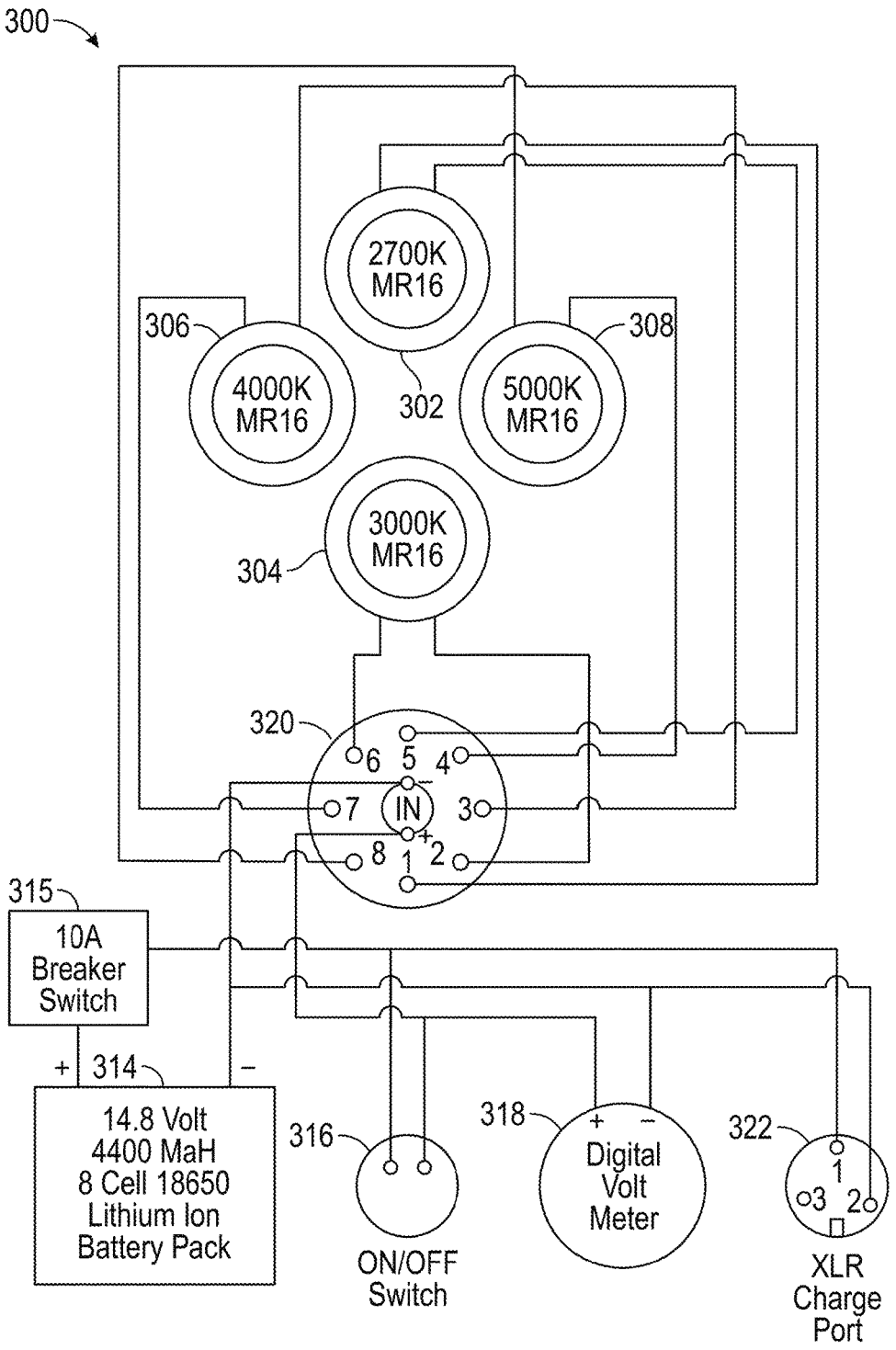
FIG. 14 shows an electrical schematic drawing of a paint color matching light according to a third exemplary embodiment of the present invention.

Alternatively, instead of a light 100 or 200 with a single bulb 102, 202, respectively, an alternative embodiment of a paint color matching light 300 according to the present invention, shown schematically in FIG. 14, can be used. Instead of a single bulb 102, 202, light 300 includes a plurality of lights 302, 304, 306, 308. Bulbs 302-308 can be MR16 bulbs rated at different ratings, such as, for example, 2700K, 3000K, 4000K, and 5000K, respectively, although those skilled in the art will recognize that bulbs with different ratings can be used. It may be necessary, in some embodiments, to reduce the outer diameter of each of bulbs 302-308 to fit into a particular housing (not shown).

Light 300 can be powered by a battery 314, such as a 14.8 volt, 4400 MaH 8 cell lithium ion battery pack, or other suitable power source. A circuit breaker, such as a 10 A breaker 315, is electrically connected to battery 314. An On/Off switch 316 is electrically connected to breaker 315. Optionally, a digital volt meter 318 and an xlr charge port 322 are also electrically connected to battery 314 and On/Off switch 316 as shown in FIG. 14.

A selector 320 is electrically connected to battery 314 and On/Off switch 316. Selector 320 allows a user to select between the four bulbs 302-308, as desired for a particular need.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A paint color matching light comprising:
a housing;
a power supply mounted in the housing; and
an LED bulb mounted in the housing and electrically coupled to the power supply, the bulb having a color reading index of about 95,
wherein the light has an absence of a cooling fan,
wherein the bulb has an operating time greater than about 5 minutes, and
wherein the bulb is rated at 5000 Kelvin.

2. The paint color matching light according to claim 1, wherein the bulb emits light in the 400 nanometer to 440 nanometer range.

3. The paint color matching light according to claim 1, wherein the bulb has an operational temperature increase of about 7 degrees Celsius.

4. The paint color matching light according to claim 1, wherein the housing has an absence of heat dissipating fins.

5. The paint color matching light according to claim 1, wherein the bulb has a viewing angle between 9 degrees and about 60 degrees.

6. The paint color matching light according to claim 5, wherein the bulb has a viewing angle of about 36 degrees.

7. The paint color matching light according to claim 1, wherein the bulb comprises a plurality of bulbs.

8. The paint color matching light according to claim 7, wherein the bulbs are rated at over 2700K.

9. The paint color matching light according to claim 7, wherein at least one bulb is rated at 5000K.

10. A paint color matching light comprising:
a housing;
a power supply mounted in the housing; and
an LED bulb mounted in the housing and electrically coupled to the power supply, the bulb being rated at 5000 Kelvin,
wherein the light has an absence of active and passive cooling mechanisms,
wherein the bulb has a color reading of about 95, and
wherein the bulb has an operating time greater than about 5 minutes.

11. The paint color matching light according to claim 10, wherein the bulb emits light in the 400 nanometer to 440 nanometer range.

12. The paint color matching light according to claim 10, wherein the bulb provides a viewing angle between 9 degrees and about 60 degrees.

13. The paint color matching light according to claim 10, wherein the bulb provides a viewing angle of about 36 degrees.

14. The paint color matching light according to claim 10, wherein the absence of active cooling mechanisms comprises an absence of cooling fans.

15. The paint color matching light according to claim 10, wherein the absence of passive cooling mechanisms comprises the absence of heat dissipating fins.

16. The paint color matching light according to claim 10, further comprising a plurality of lesser bulbs electrically coupled to the power supply, each of the plurality of lesser bulbs having a rating less than 5000K.

* * * * *